United States Patent [19]

White et al.

[11] Patent Number: 4,596,259

[45] Date of Patent: Jun. 24, 1986

[54] SMOKING MATERIAL AND METHOD FOR ITS PREPARATION

[75] Inventors: Jackie L. White, Pfafftown; Mary E. Stowe, Winston-Salem, both of N.C.

[73] Assignee: R. J. Reynolds Tobacco Company, Winston-Salem, N.C.

[21] Appl. No.: 525,055

[22] Filed: Aug. 22, 1983

[51] Int. Cl.[4] ..... A24B 15/16; A24B 1/18

[52] U.S. Cl. ..... 131/359; 131/369

[58] Field of Search ..... 131/352, 353, 360, 369–375; 44/1 D, 1 F, 10 A, 10 C

[56] References Cited

U.S. PATENT DOCUMENTS

| | | | |
|---|---|---|---|
| 3,844,294 | 10/1974 | Webster | 131/353 |
| 3,931,824 | 1/1976 | Miano et al. | 131/353 |
| 3,993,082 | 11/1976 | Martin et al. | 131/353 |
| 4,002,176 | 1/1977 | Anderson et al. | 131/353 |
| 4,019,521 | 4/1977 | Briskin | 131/353 |
| 4,119,104 | 10/1978 | Roth | 131/353 |
| 4,233,993 | 11/1980 | Miano et al. | 131/353 |
| 4,244,381 | 1/1981 | Lendvay | 131/353 |
| 4,256,123 | 3/1981 | Lendvay et al. | 131/353 |

FOREIGN PATENT DOCUMENTS

| | | | |
|---|---|---|---|
| 1519206 | 7/1978 | United Kingdom | 131/353 |
| 1553326 | 9/1979 | United Kingdom | 131/353 |

OTHER PUBLICATIONS

"The Effect of Inorganic Additives on the Formation Composition, and Combustion of Cellulose Char" by Sekiguchi et al., Journal of Applied Polymer Science, vol. 29; 1267–1286 (1984).

*Primary Examiner*—V. Millin

*Attorney, Agent, or Firm*—Herbert J. Bluhm

[57] ABSTRACT

A composition for use in smoking products is prepared from thermally degraded tobacco plant materials and a water-soluble polysaccharide gum.

36 Claims, No Drawings

SMOKING MATERIAL AND METHOD FOR ITS PREPARATION

TECHNICAL FIELD

This invention relates to a smoking material prepared from thermally degraded tobacco and water soluble gums that is suitable for blending with conventionally processed tobacco in the manufacture of smoking products therefrom.

BACKGROUND ART

The investigation of smoking materials other than conventionally processed tobaccos has been the subject of increased interest in recent years. This interest has been generated primarily by the desire to alter the composition of smoke produced by smoking products based on conventionally processed tobaccos. It is possible, for example, to lower the quantity of nicotine in the smoke of a cigarette by replacing a portion of the tobacco with specially processed smoking materials containing little, if any, nicotine.

A large body of art exists which involves chemical and/or thermal degradation of carbohydrates in the preparation of smoking materials. The degradation products are combined with various inorganic salts, binders, flavorants, dyes, etc. and formed into sheets or shreds which are intended to simulate tobacco. These smoking materials have never duplicated the flavor and aroma of tobacco although they have met with a certain degree of success in providing a product with acceptable burn and ash characteristics. These tobacco substitutes have not found widespread consumer acceptance because they are composed largely, if not completely, of non-tobacco materials which produce flavor characteristics that are foreign to consumers of smoking products containing the substitutes.

A smoking product which seeks to retain the smoking characteristics of tobacco while at the same time realizing the advantages of thermally degraded carbohydrate materials is disclosed in U.S. Pat. No. 4,002,176. That patent describes the thermal degradation of tobacco in the presence of a catalyst at 100° to 300° C. until the weight of the thermally treated tobacco is preferably between 70 and 90 percent of the original weight. The catalysts employed are typically acidic in nature and it should be noted that column 2 of the patent teaches that tobacco heated in the absence of catalyst does not produce a satisfactory material.

Another method for the thermal degradation of tobacco is disclosed in U.S. Pat. No. 4,244,381. Tobacco by-product materials, particularly stems, are subjected to a heating step at 150° to 370° C. to give a weight loss of 10 to 35 percent and to a water extraction step to remove water-soluble constituents. The order in which these steps are carried out is not critical but the treatment conditions must be carefully controlled so that the treated tobacco materials can be incorporated directly into a smoking product without subsequently forming the treated materials into a sheet. The teachings (see Example 2) indicate that the water extraction step is essential.

Another smoking material which contains thermally degraded tobacco is disclosed in U.S. Pat. No. 4,256,123. Tobacco by-product materials such as stems, stalks and fines are subjected to pyrolysis at temperatures up to 700° C. and the pyrolysis product is homogenized with untreated tobacco parts in a conventional reconstituted tobacco manufacturing process. The patent teaches that the proportion of pyrolyzed tobacco by-product which can be incorporated into such a reconstituted tobacco is preferably less than 0.6 part per part (dry weight) of untreated tobacco and is typically used in amounts of approximately 0.15 part of pyrolyzed material per part of untreated tobacco. Of particular interest in the patent disclosure are data showing comparative reduction of total particulate matter (TPM) and nicotine in cigarettes containing the disclosed reconstituted tobacco with pyrolyzed tobacco by-products as well as a similar reconstituted tobacco containing activated carbon instead of the pyrolyzed tobacco by-products. The cigarettes containing the pyrolyzed tobacco were found to give a greater reduction in both TPM and nicotine. Although the pyrolyzed tobacco by-products material is a desirable component in cigarettes and other smoking products, its impact on smoke composition is severely limited by virtue of its incorporation into reconstituted tobacco. Harshness associated with reconstituted tobaccos generally limits their use levels in cigarettes to 40 percent or less of the total weight of the cut filler. Thus, the examples in U.S. Pat. No. 4,256,123 describe cigarettes containing a maximum of 6 percent by weight of the pyrolyzed tobacco by-product component.

Related to the disclosures of various degraded carbohydrates as smoking materials is the use of binders and adhesives in converting the degraded carbohydrates into a stable, useful form. U.S. Pat. No. 3,844,294 discloses, for example, a smoking material based on thermally degraded carbohydrates which includes methylcellulose, sodium carboxymethycellulose, pectins and gums as binders or film-forming agents. Similar binders or adhesives are disclosed in U.S. Pat. No. 4,019,521 as well as a number of additional patents although they are generally used in combination with a variety of inorganic fillers, combustion control agents, ash cohesion agents, flavorants, etc. necessary for the preparation of an acceptable smoking material. Although the binders or film-forming agents are necessary for producing a coherent strand or sheet, such agents are also widly regarded as the source of objectionable odors and acridity commonly associated with smoking products containing them.

BRIEF SUMMARY OF THE INVENTION

This invention provides an improved smoking product based predominantly on tobacco materials which have been subjected to pyrolysis.

It is a principal object of this invention to provide a smoking material that can be blended with tobacco in a wide range of proportions to produce a smoking product having reduced levels of nicotine and total particulate matter in the smoke.

It is a further object of this invention to provide a smoking material which has satisfactory combustion properties without the need for addition of special agents to control the combustion process.

It is yet a further object of this invention to provide a smoking material comprised of pyrolyzed tobacco materials and an adhesive agent which does not have associated therewith the harshness that is characteristic of reconstituted tobacco materials.

Other objects and advantages will be apparent from the detailed description which follows.

DETAILED DESCRIPTION OF THE INVENTION

Numerous processes have been described for utilizing thermally degraded carbohydrate materials in the preparation of smoking products. The thermally degraded materials are combined with various additives to produce a product having acceptable burning properties, ashing characteristics, moisture retention and smoke flavor. Such additives are, in many cases, impractical from an economic point of view or they may alter the combustion temperatures during smoking thereby affecting the composition of the smoke produced.

Surprisingly, it has now been discovered that a very satisfactory smoking composition can be produced which consists predominantly of pyrolyzed tobacco plant materials and relatively low levels of certain adhesive agents which bind the pyrolyzed tobacco plant materials into a form that is suitable for use in the manufacture of smoking products. Equally surprising is the discovery that this composition requires no additives to control the burning and ash properties. It has also been found that, upon smoking, this composition does not exhibit the harshness commonly associated with reconstituted tobaccos prepared from tobacco materials which have not been subjected to pyrolysis. Since the compositions disclosed herein do not exhibit the harshness of reconstituted tobaccos, they may be combined with good quality tobaccos in various proportions up to 50 percent or more in the manufacture of smoking products therefrom. Thus, these compositions provide versatile and unique means for controlling nicotine and total particulate matter (TPM) in the smoke of products containing such compositions.

The pyrolyzed tobacco plant materials used in accordance with this invention may be prepared from any portion of the tobacco plant. In actual practice, however, it is preferred to use tobacco stems, stalks, scrap and dust which result from the conventional processing of tobacco incident to the manufacture of tobacco products. The moisture content of such materials normally ranges between 8 and 30 percent by weight. Pyrolysis of the tobacco materials is carried out by heating the materials at temperatures of 300° C. to 700° C. in an inert or non-oxidizing atmosphere for periods of 0.5 to 3 hours in length. Heating of the tobacco materials may be effected by a convection oven, muffle furnace or any other suitable heating device provided with means for maintaining an inert or non-oxidizing atmosphere (e.g., nitrogen, carbon dioxide or argon) which surrounds the materials being pyrolyzed. The heat treatment may also be conducted under vacuum conditions to obviate the need for an inert or non-oxidizing atmosphere. The heating time will depend, of course, on the rate of temperature increase, the initial temperature of the oven or heating device, the maximum temperature reached and the degree of thermal degradation desired. Although heating of the materials may be carried out at a constant temperature, the pyrolysis treatment is preferably programmed so that the temperature is increased gradually over a period of time with the maximum temperature levels being maintained for a time sufficient to effect a weight loss of 35 to 90 percent for the entire pyrolysis treatment period. Preferably, the weight loss effected during the pyrolysis treatment is from 45 to 70 percent. These weight loss percentages are based on the initial weight of the tobacco materials used as starting material, it being understood that the initial moisture content of these materials is normally between 8 and 30 percent by weight.

Following the pyrolysis treatment the inert or non-oxidizing atmosphere is maintained over the pyrolyzed material until it has cooled to temperatures of less than 50° C. The cooled material is then milled to give a particulate material having maximum particle sizes of approximately 100 microns or, preferably, maximum particle sizes of 50 microns. The pyrolyzed material may be reduced to particulate form using commercially available apparatus such as a DM-3C SWECO Vibro-Energy Dry Grinding Mill available from SWECO Inc. of Los Angeles, Calif. The SWECO mill is suitable for milling the dry pyrolyzed material. It is preferred, however, that the material be placed in water and milled to the desired particle sizes using a suitable mill such as the Model 504 Morehouse mill available from Morehouse-Cowles, Inc. of Los Angeles, Calif.

The pyrolyzed and milled tobacco plant materials are converted into a form suitable for use in the manufacture of smoking products by combining the materials with binders or adhesives and sufficient water to produce a paste that can be shaped and dried. It is important that the proper adhesive agents be used in appropriate amounts so that the resulting product will have acceptable characteristics. For example, the shaped material must have sufficient tensile strength to withstand further processing in the manufacture of smoking products therefrom, it must have satisfactory burning properties and it must not impart objectionable flavor and aroma to the smoke produced during the burning process.

The adhesive agents useful in connection with this invention are water-soluble polysaccharide gums of either natural or synthetic origin. The gums of synthetic origin are intended to include natural gums which have been chemically modified to alter solubility and/or adhesive properties. Adhesive agents which may be used include gum arabic, gum ghatti, gum karaya, gum tragacanth, locust bean gum, guar gum, pectins, algins, carrageenans, agar, arabinogalactan, dextrans, xanthans, starches, starch ethers, starch esters, cellulose ethers and cellulose esters. Particularly preferred are guar gum or sodium carboxymethylcellulose or mixtures thereof.

The pyrolyzed and milled tobacco plant materials are formed into a smokable composition by combining with water and one or more of the water-soluble polysaccharide gums in weight proportions such that at least 45 percent and preferably from 60 to 95 percent of the dry weight of the composition comprises the pyrolyzed tobacco plant materials. The amount of water added to the pyrolyzed material and gum should be sufficient to produce a paste that can be extruded into a small continuous strand approximating the size of individual shreds of tobacco used as filler material in the manufacture of cigarettes. Alternatively, the paste can also be formed into sheets for subsequent shredding, if desired. The amount of water required to form a paste of proper consistency will depend to some extent on the polysaccharide gums being used but 2 to 3 parts of water per part of pyrolyzed material (dry weight basis) are generally sufficient to produce a satisfactory paste. Extrusion or sheet forming can be effected by various techniques known to those skilled in the art. For example, the paste can be cast on a metal surface and dried to a moisture content of 10 to 20 percent by weight, and preferably, 13 to 16 percent by weight before further conventional processing.

In referring to the dry weight of the various materials in this specification and the claims, dry weight is defined as the residual weight of the material after the material has been heated for 15 minutes in an oven that is maintained at 124° C. and excludes the weight of relatively non-volatile additives such as humectants and casing materials which may have been previously applied to the materials.

As noted above, the pyrolyzed tobacco plant materials may constitute from 45 to 95 percent of the dry weight of the formed smokable composition. The polysaccharide gum component of the smokable composition should constitute at least 5 percent and, preferably, at least 10 percent of the dry weight of the composition. Although the polysaccharide gum may constitute up to 55 percent of the dry weight of the smokable composition, it is preferred that the gum constitute between approximately 10 and 40 percent of the dry composition. Most preferred are compositions in which guar gum and/or sodium carboxymethylcellulose are included in the polysaccharide gum component and constitute at least 35 percent of the gum component combined with the pyrolyzed tobacco plant materials. The compositions thus formed exhibit satisfactory glow sustaining and ashing characteristics when incorporated into a cigarette.

Other additives may be incorporated into or applied to the formed strand or sheet, if desired. For example, humectants such as glycerol, propylene glycol, diethylene glycol and triethylene glycol may be combined with the pyrolyzed tobacco plant materials and polysaccharide gums to reduce brittleness in the formed and dried strand or sheet. Humectant levels of up to 5 percent by weight based on the dry weight of the smokable composition are generally sufficient to produce the desired effect. Propylene glycol is especially preferred as a humectant and it may conveniently be sprayed onto the formed strands or sheet of the smokable composition.

Low levels of flavoring materials may also be added to the compositions disclosed herein. Use levels will depend on the flavorant selected but will generally be in the range of 0.0001 to 0.1 percent by weight based on the dry weight of the smokable composition. The flavoring materials may be incorporated into the paste or they may be applied to the formed strands or sheets by spraying, dipping or other suitable techniques.

Proteinaceous materials as well as nicotine or nicotine precursors may also be included in the compositions to provide additional flavoring or stimulating effects.

Since the smokable compositions based on pyrolyzed tobacco plant materials may be somewhat darker in color than tobacco leaf normally used in the manufacture of smoking products, it is desirable to apply suitable finely divided solid material having a tobacco-like color associated therewith to the surface of the compositions to produce colors similar to natural tobaccos. A preferred means for coloring the compositions is to apply finely divided tobacco dust to the surface of the previously formed strand or sheet using techniques such as those described in United Kingdom patent No. 1,553,326 the teachings of which are incorporated herein by reference. Also suitable for use are certain puffed cereal grains which have been toasted at elevated temperatures to impart a tobacco-like color thereto and milled to a finely divided powder before applying to the surface of the formed strand or sheet of the smokable composition.

After the smokable compositions based on the pyrolyzed tobacco plant materials have been prepared and converted into the desired shape or form, they are used in the manufacture of smoking products such as cigarettes and cigars. The compositions are preferably used in combination with tobacco in the manufacture of smoking products. The proportions of pyrolyzed tobacco compositions used in such smoking products will depend on the effects desired but generally the weight ratio of tobacco to pyrolyzed tobacco compositions will range from 20:1 to 1:1, respectively. It is possible to use pyrolyzed tobacco compositions in combinations with tobacco wherein the compositions constitute more than 50 percent of the total weight of the combinations; however, the use of such high proportions requires added flavoring materials to compensate for the reduced flavor effect caused by the low proportion of tobacco in the combinations. The moisture levels of the compositions containing the pyrolyzed tobacco plant materials should be similar to those of the tobacco with which it is combined. These moisture levels are generally in the range of 10 to 15 percent by weight.

The following examples will serve to illustate further the manner in which the presently disclosed invention may be carried out.

EXAMPLE 1

Pyrolysis of tobacco plant materials was effected by placing an 8 to 15 centimeter thick layer of the materials into a stainless steel vessel provided with closure means and gas inlet and outlet means. The vessel was placed in an oven and a source of nitrogen gas was connected to the gas inlet means to maintain a flow of nitrogen gas through the closed vessel. The nitrogen gas provided an inert atmosphere in the vessel and also served as a carrier to remove pyrolysis products from the vessel. The oven was heated gradually over a period of 2 to 3 hours to a temperature of 650° C. and held at the maximum temperature for about 1 hour. The oven was allowed to cool to approximately 25° C. while the flow of nitrogen through the vessel was continued. Shown in Table 1 below are typical results obtained by pyrolyzing various tobacco plant materials with the listed weight loss percentages being based on the initial weight of the starting materials.

TABLE 1

| Starting Material | Maximum Temperature °C. | Total Heating Time (Hours) | Percent Weight Loss |
|---|---|---|---|
| Burley Tobacco Stems | 650 | 5 | 59 |
| Burley Tobacco Stalks | 650 | 5 | 74 |
| Flue Cured Tobacco Stems | 650 | 5 | 64 |
| Flue Cured Tobacco Stalks | 650 | 5 | 80 |

EXAMPLE 2

Pyrolyzed tobacco materials prepared as described in Example 1 were milled in an aqueous medium to obtain particle sizes of 100 microns or less. One part by weight of the pyrolyzed material was combined with two parts by weight of water and the resulting mixture was agitated using a food-type mixer manufactured by Hobart Corporation of Troy, Ohio for a sufficient period of time to reduce the large pieces to a size that could be fed into the inlet of a Model 504 Morehouse mill obtained from Morehouse-Cowles, Inc. of Los Angeles, Calif. Grinding of the water-suspended material in the Morehouse mill resulted in an aqueous slurry of finely divided, pyrolyzed tobacco material having a maximum particle size of approximately 100 microns.

EXAMPLE 3

An aqueous slurry of finely divided, pyrolyzed tobacco material prepared in accordance with Examples 1 and 2 was combined with various polysaccharide gums, humectant (optional) and additional water (if necessary). The resulting mixture was thoroughly blended using a Hobart HCM-450 cutter/mixer provided with a cut/mix attachment and mixing baffle to give a uniform thick paste consistency. A continuous ribbon of the thick paste was deposited on the surface of a metal ring having a width of approximately 10 centimeters and a diameter of about 92 centimeters. The ribbon of paste was spread out into a thin sheet by a flexible metal strip maintained at a fixed distance from the surface of the metal ring. The metal ring was provided with means for rotating the ring at approximately 22 revolutions per hour. Surrounding about one half of the ring was a metal housing and associated gas heater which directed a hot gaseous fluid onto the thin sheet of paste. The gaseous fluid moved in a direction that was generally countercurrent to the direction of movement of the ring and the maximum temperature of the gaseous fluid was about 690° C. At a point intermediate its exit from the metal housing and the point at which the paste was deposited onto the metal ring was a doctor blade which removed the partially dried sheet of material from the surface of the ring. The moisture content of the sheet was approximately 20 to 30 percent and the thickness of the sheet was between 0.3 and 0.6 millimeter at the time it was removed from the metal ring. The sheet was cut into pieces which approximated the size of tobacco strips produced by conventional tobacco stemming procedures. Various sheet compositions were prepared and are listed in Tables 2A and 2B. The quantities of water listed in the tables include the amounts used for wet milling of the pyrolyzed material. The moisture content of the formed sheets was adjusted to approximately 18 to 20 percent, the sheets were then shredded and the combustion characteristics of the shredded material were evaluated. All of the compositions prepared were found to have acceptable aroma, burning and ashing characteristics.

TABLE 2A

| | Quantity of Pyrolyzed Flue Cured Stem Material | Polysaccharide Gum[1] | Water | Other Components[2] |
|---|---|---|---|---|
| 1. | 100 g. | CMC, 14 g. | 300 g. | Glycerol, 4.2 g. |
| 2. | 100 g. | CMC, 9 g. Guar gum, 5 g. | 300 g. | Glycerol, 3 g. |
| 3. | 100 g. | CMC, 9 g. Hydroxy-propylated starch, 5 g. | 200 g. | Glycerol, 2.7 g. |
| 4. | 90 g. | CMC, 92 g. Guar gum, 18 g. | 1500 g. | Propylene glycol, 2.4 g. |
| 5. | 100 g. | CMC, 9 g. Hydroxy-ethylated starch, 5 g. | 200 g. | Glycerol, 2.7 g. |
| 6. | 95 g. | CMC, 4 g. Guar gum, 1 g. | 250 g. | Propylene glycol, 1.2 g. |
| 7. | 100 g. | CMC, 9 g. Xanthan gum, 5 g. | 250 g. | Glycerol, 2.8 g. |
| 8. | 130 g. | CMC, 60 g. Guar gum, 10 g. | 1000 g. | Propylene glycol, 2.4 g. |

TABLE 2B

| | Quantity of Pyrolyzed Flue Cured Stem Material | Polysaccharide Gum[1] | Water |
|---|---|---|---|
| 1. | 100 g. | Guar gum, 14 g. | 300 g. |
| 2. | 100 g. | CMC, 9 g. Guar gum, 5 g. | 300 g. |
| 3. | 100 g. | Guar gum, 5 g. Hydroxypropylated starch, 9 g. | 250 g. |
| 4. | 100 g. | Guar gum, 5 g. Hydroxyethylated starch, 9 g. | 200 g. |
| 5. | 100 g. | CMC, 9 g. Locust bean gum, 5 g. | 300 g. |
| 6. | 100 g. | Guar gum, 5 g. Xanthan gum, 9 g. | 200 g. |
| 7. | 100 g. | Guar gum, 5 g. Locust bean gum, 5 g. Xanthan gum, 4 g. | 200 g. |

[1]CMC is sodium carboxymethylcellulose (Hercules 7HF), the guar gum is Hercules FG-60-30 and the locust bean gum is Hercules FL-70-50, all available from Hercules Incorporated of Wilmington, Delaware. The xanthan gum is available from the KelcoDivision of Merck & Co., Inc. in San Diego, California. The hydroxypropylated starch and hydroxyethylated starch are available from National Starch & Chemical Corporation of Bridgewater, New Jersey.

[2]The amount of glycerol shown was incorporated into the paste prior to forming the paste into a sheet. The propylene glycol amounts shown were applied to the previously formed sheets.

EXAMPLE 4

Pyrolyzed tobacco materials prepared as described in Example 1 were milled in a DM-3C SWECO Vibro-Energy Dry Grinding Mill manufactured by SWECO Inc. of Los Angeles, Calif. to give a finely divided powder having a maximum particle size of about 75 microns. The powder was combined with polysaccharide gums in an aqueous medium and formed into a thin sheet using the procedure described in Example 3. The sheet compositions prepared are listed in Table 3 and each composition was found to have acceptable aroma, burning and ashing characteristics.

TABLE 3

| | Pyrolyzed Material | Polysaccharide Gum* | Water | Other Components |
|---|---|---|---|---|
| 1. | Pyrolyzed Flue Cured Stalks, 100 g. | CMC, 9 g. Guar Gum, 5 g. | 350 g. | Glycerol, 2.7 g. |
| 2 | Pyrolyzed Burley Stems, 100 g. | CMC, 9 g. Guar Gum, 5 g. | 300 g. | Glycerol, 2.7 g. |
| 3. | Pyrolyzed Burley Stalks, | CMC, 9 g. Guar Gum, 5 g. | 350 g. | Glycerol, 2.7 g. |

TABLE 3-continued

| Pyrolyzed Material | Polysaccharide Gum* | Water | Other Components |
|---|---|---|---|
| 100 g. | | | |

*CMC is sodium carboxymethylcellulose (Hercules 7HF) and the guar gum is Hercules FG-60-30, both available from Hercules Incorporated of Wilmington, Delaware.

EXAMPLE 5

Burley tobacco stems were pyrolyzed and converted into sheets as described in Example 4. The moisture level of the sheet material was adjusted to 10 percent and propylene glycol was sprayed onto the sheet to give a final concentration of 1.25 percent by weight based on the dry weight of the sheet. The sheet material was then shredded and blended in various proportions with a commercial blend of cut tobacco used for manufacturing cigarettes. The cigarettes made with the cut tobacco/shredded sheet material mixture were then smoked under standard conditions and both nicotine and total particulate matter (TPM) were determined. The cigarette containing only cut tobacco yielded 7.8 puffs, 7.2 mg. of TPM and 0.52 mg. of nicotine. The cigarettes containing 70 parts tobacco and 30 parts of the pyrolyzed tobacco composition yielded 8.9 puffs, 5.5 mg. TPM and 0.37 mg. of nicotine. Cigarettes containing equal amounts of tobacco and the pyrolyzed tobacco composition yielded 9.1 puffs, 4.1 mg. TPM and 0.22 mg. of nicotine.

EXAMPLE 6

The procedure of Example 5 was repeated except that the pyrolyzed tobacco material used for preparing the sheets was derived from flue cured tobacco stalks. Cigarettes containing only tobacco yielded 7.8 puffs, 7.1 mg. TPM and 0.54 mg. of nicotine. Those containing 70 parts tobacco and 30 parts pyrolyzed tobacco composition yielded 8.4 puffs, 5.7 mg. TPM and 0.41 mg. of nicotine whereas cigarettes containing equal amounts of tobacco and pyrolyzed tobacco composition yielded 8.5 puffs, 3.7 mg. TPM and 0.27 mg. of nicotine.

EXAMPLE 7

The procedure of Example 5 was repeated except that the pyrolyzed tobacco material used for preparing the sheets was derived from burley tobacco stalks. Cigarettes containing tobacco only yielded 8.5 puffs, 7.0 mg. TPM and 0.58 mg. of nicotine. Cigarettes containing 70 parts tobacco and 30 parts pyrolyzed tobacco composition yielded 9.4 puffs, 4.7 mg. TPM and 0.37 mg. of nicotine while those containing equal amounts of the two filler materials yielded 9.4 puffs, 3.5 mg. TPM and 0.25 mg. of nicotine.

EXAMPLE 8

Flue cured tobacco stems were pyrolyzed as described in Example 1, milled in accordance with Example 2 and converted into sheets by the procedure of Example 3 using 9 g. of CMC, 5 g. of guar gum, 2.7 g. of glycerol and 350 grams of water per 100 grams of finely milled pyrolyzed material. The moisture level of the sheet material was adjusted to 20 percent and propylene glycol was sprayed onto the sheet to give a final concentration of 1.25 percent by weight based on the dry weight of the sheet. The sheet material was then shredded and blended in various proportions with a commercial blend of cut tobacco used for manufacturing cigarettes. The cigarettes prepared from the resulting blend were then smoked under standard conditions and both nicotine and total particulate matter were determined. Cigarettes containing tobacco only yielded 7.4 puffs, 7.3 mg. TPM and 0.56 mg. of nicotine. Cigarettes containing 70 parts tobacco and 30 parts pyrolyzed tobacco composition yielded 8.6 puffs, 5.5 mg. TPM and 0.37 mg. of nicotine and cigarettes containing equal amounts of tobacco and pyrolyzed tobacco compositions yielded 9.2 puffs, 4.1 mg. TPM and 0.27 mg. of nicotine.

The cigarettes prepared as described above were also evaluated by a panel of expert smokers in a comparison test with the control cigarettes containing only the commercial blend of cut tobacco. The test cigarettes were adjudged by the panel to be milder and to possess somewhat less tobacco taste than the control cigarette. Nevertheless, the taste of the test cigarettes were regarded as quite acceptable even when equal amounts of cut tobacco and pyrolyzed tobacco composition were used. It was also observed that the test cigarettes produced less sidestream smoke than the control cigarettes.

EXAMPLE 9

The procedure of Example 8 was repeated except that the shredded sheet material prepared from the pyrolyzed tobacco composition was coated with a coloring agent to impart a tobacco-like color to the shredded sheet material. The coloring agent used was obtained by heating puffed, shredded milo (see U.S. Pat. No. 3,964,494) in an oven at temperatures of 200° C. for a period of time sufficient to toast the milo and to cause it to become brown in color. The shredded and toasted milo was milled in a DM-3C SWECO Vibro-Energy Dry Grinding mill until the average particle size was approximately 10 microns or less.

Two hundred grams of the shredded pyrolyzed tobacco composition was placed in an inclined drum-shaped container provided with means for rotating the container and mixing the contents thereof. An adhesive solution consisting of 50 grams of invert sugar, 20 grams of water, 2 grams of propylene glycol and 15 grams of glycerol was sprayed onto the shredded, pryrolyzed tobacco composition as it tumbled in the rotating container. Immediately following application of the adhesive solution, 100 grams of the toasted and milled milo was sprinkled onto the shredded, pyrolyzed tobacco composition as it continued to tumble in the rotating container. The finely divided milo adhered uniformly to the surface of the shredded, pyrolyzed tobacco composition and imparted thereto a tobacco-like brown color.

What is claimed is:

1. A composition for use in smoking products which comprises at least 45 percent by weight (dry weight basis) of pyrolyzed tobacco plant materials and at least 5 percent by weight (dry weight basis) of a water-soluble polysaccharide natural or synthetic gum wherein said pyrolyzed tobacco plant materials are derived by subjecting tobacco plant parts to pyrolysis in a non-oxidizing atmosphere at temperatures of at least 300° C. for a period of time sufficient to effect a weight loss of 35 to 90 percent based on the initial weight of the tobacco plant materials.

2. The composition of claim 1 which includes a humectant agent in amounts up to 5 percent by weight based on the dry weight of said composition.

3. The composition of claim 2 wherein the humectant agent is selected from the group consisting of glycerol, propylene glycol, diethylene glycol and triethylene glycol.

4. The composition of claim 1, 2 or 3 wherein at least 35 percent by weight of said gum is selected from the group consisting of sodium carboxymethylcellulose and guar gum.

5. The composition of claim 1, 2 or 3 wherein said pyrolyzed tobacco plant materials comprise at least 70 percent by weight (dry weight basis) of said composition.

6. The composition of claim 4 wherein the composition is in the form of shreds suitable for use as a filler for cigarettes and said shreds have a coating of a finely divided solid material applied to the surface of the shreds, said finely divided solid material having a tobacco-like color associated therewith.

7. The composition of claim 6 wherein said finely divided solid material comprises tobacco dust.

8. The composition of claim 5 wherein the composition is in the form of shreds suitable for use as a filler for cigarettes and said shreds have a coating of a finely divided solid material applied to the surface of the shreds, said finely divided solid material having a tobacco-like color associated therewith.

9. The composition of claim 8 wherein said finely divided solid material comprises tobacco dust.

10. The composition of claim 1, 2 or 3 which includes an added flavoring material.

11. A composition for use in smoking products which comprises from 45 to 95 percent by weight (dry weight basis) of tobacco plant materials previously pyrolyzed in an inert or non-oxidizing atmosphere at temperatures of 300° C. to 700° C. for a period of time sufficient to effect a weight loss of 35 to 90 percent based on the initial weight of said tobacco plant materials and from 5 to 55 percent by weight (dry weight basis) of a water-soluble polysaccharide natural or synthetic gum.

12. The composition of claim 11 wherein at least 35 percent by weight of said gum is selected from the group consisting of sodium carboxymethylcellulose and guar gum.

13. The composition of claim 11 wherein said tobacco plant materials are previously pyrolyzed to effect a weight loss of 45 to 70 percent.

14. The composition of claim 13 wherein at least 35 percent by weight of said gum is selected from the group consisting of sodium carboxymethylcellulose and guar gum.

15. The composition of claim 11, 12, 13 or 14 which additionally includes up to 5 percent by weight, based on the dry weight of said composition, of a humectant agent selected from the group consisting of glycerol, propylene glycol, diethylene glycol and triethylene glycol.

16. The composition of claim 15 wherein the composition is in the form of shreds suitable for use as a filler for cigarettes and said shreds have a coating of a finely divided solid material applied to the surface of said shreds, said finely divided solid material having a tobacco-like color associated therewith.

17. The composition of claim 16 wherein said finely divided solid material comprises tobacco dust.

18. The composition of claim 11, 12, 13 or 14 which includes an added flavoring material.

19. The composition of claim 15 which includes an added flavoring material.

20. A cigarette containing a smokable filler material comprisng a mixture of cut tobacco and a smokable composition that includes tobacco plant materials previously pyrolyzed in a non-oxidizing atmosphere at temperatures of at least 300° C. for a period of time sufficient to effect a weight loss of at least 35 percent based on the initial weight of said tobacco plant materials and a water-soluble polysaccharide natural or synthetic gum which acts as an adhesive binder for the tobacco plant materials, said smokable composition being further characterized as containing at least 40 percent by weight (dry weight basis) of said previously pyrolyzed tobacco plant materials and at least 5 percent by weight (dry weight basis) of said water-soluble polysaccharide natural or a synthetic gum.

21. The cigarette of claim 20 wherein said tobacco plant materials are previously pyrolyzed at temperatures of 300° C. to 700° C. to effect a weight loss of 45 to 70 percent and the pyrolyzed tobacco plant materials comprise at least 75 percent by weight (dry weight basis) of said smokable composition.

22. The cigarette of claim 20 or 21 wherein said smokable composition additionally contains an added flavoring material and up to 5 percent by weight, based on the dry weight of the smokable composition, of a humectant agent selected from the group consisting of glycerol, propylene glycol, diethylene glycol and triethylene glycol.

23. The cigarette of claim 22 wherein at least 35 percent by weight of said gum is selected from the group consisting of sodium carboxymethylcellulose and guar gum.

24. The cigarette of claim 20 or 21 wherein said smokable composition is in the form of strands or shreds resembling cut tobacco and comprises up to 50 percent by weight of said mixture.

25. The cigarette of claim 22 wherein said smokable composition is in the form of strands or shreds resembling cut tobacco suitable for use as a filler for cigarettes and comprises up to 50 percent by weight of said mixture, said strands or shreds being further characterized as having a finely divided solid material possessing a tobacco-like color applied to the surface thereof.

26. The cigarette of claim 25 wherein said finely divided solid material comprises tobacco dust.

27. The cigarette of claim 23 wherein said smokable composition is in the form of strands or shreds resembling cut tobacco suitable for use as a filler for cigarettes and comprises up to 50 percent by weight of said mixture, said strands or shreds being further characterized as having a finely divided solid material possessing a tobacco-like color applied to the surface thereof.

28. The cigarette of claim 27 wherein said finely divided solid material comprises tobacco dust.

29. A method for preparing a smokable composition which comprises (a) pyrolyzing tobacco plant materials at temperatures of at least 300° C. for a period of time sufficient to effect a weight loss of 35 to 90 percent based on the initial weight of the tobacco plant material, (b) milling the pyrolyzed tobacco plant materials to produce a particulate material having a maximum particle size of approximately 100 microns, (c) preparing a paste from the pyrolyzed and milled tobacco plant materials, water and a water-soluble polysaccharide natural or synthetic gum with the pyrolyzed and milled tobacco plant materials constituting at least 45 percent of the dry weight of said paste, (d) forming the paste into a strand or sheet, and (e) drying the formed strand or sheet to a moisture content of 10 to 20 percent by weight.

30. The method of claim 29 wherein said tobacco plant materials are pyrolyzed in an inert or non-oxidizing atmosphere at temperatures of 300° C. to 700° C. for a period of time sufficient to effect a weight loss of 45 to 70 percent.

31. The method of claim 29 or 30 wherein from 45 to 95 parts by weight of said pyrolyzed and milled tobacco plant materials are combined with 5 to 55 parts by weight of said water-soluble gum in preparing said paste.

32. The method of claim 31 wherein at least 35 percent by weight of said water-soluble gum comprises a gum selected from the group consisting of sodium carboxylmethylcellulose and guar gum.

33. The method of claim 29 or 30 which includes the additional step of incorporating into said smokable composition up to 5 percent by weight, based on the dry weight of the smokable composition, of a humectant agent selected from the group consisting of glycerol, propylene glycol, diethylene glycol and triethylene glycol.

34. The method of claim 29 or 30 which includes the additional step of incorporating into said smokable composition an added flavoring material.

35. The method of claim 29 or 30 which includes the additional step of applying a coating of finely divided solid material to the surface of said strand or sheet, said finely divided solid material having a tobacco-like color associated therewith.

36. The method of claim 35 wherein said finely divided solid material comprises tobacco dust.

* * * * *